United States Patent [19]

Winyard et al.

[11] 3,977,260

[45] Aug. 31, 1976

[54] MEANS FOR ADJUSTING THE MOVEMENT OF MOVING HEAD FANS

[75] Inventors: Frank Leslie Winyard, Lower Templestow; James Graham, Eltham; Edward Henry Brattstrom, Pascoe Vale South, all of Australia

[73] Assignee: Kemtron Properties Pty. Limited, Melbourne, Australia

[22] Filed: Feb. 19, 1975

[21] Appl. No.: 551,007

[30] Foreign Application Priority Data

Feb. 19, 1974 Australia ..... 6648/74

[52] U.S. Cl. ..... 74/86; 416/80

[51] Int. Cl.[2] ..... F16H 33/10

[58] Field of Search ..... 74/117, 86; 416/79, 416/80, 81

[56] References Cited

UNITED STATES PATENTS

| | | | |
|---|---|---|---|
| 2,014,954 | 9/1935 | Sheridan | 74/117 |
| 2,162,375 | 6/1939 | Chrisman | 74/117 |

FOREIGN PATENTS OR APPLICATIONS

| | | | |
|---|---|---|---|
| 261,129 | 11/1927 | Italy | 416/79 |
| 334,909 | 9/1930 | United Kingdom | 416/80 |

*Primary Examiner*—Samuel Scott
*Assistant Examiner*—Wesley S. Ratliff, Jr.
*Attorney, Agent, or Firm*—Finnegan, Henderson, Farabow & Garrett

[57] ABSTRACT

This specification discloses an improved means for adjusting the movement of a gyratory head fan comprising a turntable driven by the fan motor and supporting an adjusting mechanism which changes the position of a socket member for the ball of a gyratory linkage with respect to the axis of rotation of the turntable. The adjusting mechanism comprises a rim which may be held against rotation relative to the turntable, lugs on the rim which engages lugs on a rotatably mounted member incorporating the socket such that the member is rotated to change position of the socket. The rim may be held against rotation by means of a plunger which engages projections on the rim. Spring loaded pawl means may be provided to hold the member in several predetermined positions to provide different modes of operation.

6 Claims, 5 Drawing Figures

MEANS FOR ADJUSTING THE MOVEMENT OF MOVING HEAD FANS

This invention relates to an improved means for adjusting the movement of moving head fans, and in particular the gyratory pattern of gyratory fans.

Most gyratory fans have means whereby the gyratory movement of the fan can be adjusted from zero movement to full movement through at least one intermediate position. The most common means comprises a plate that holds the ball element of the gyratory linkage in one of several sockets located at the centre and at two other off centre positions of a rotatable turntable for creating the gyratory movement. The plate is held in position by a screw that must be loosened or removed for adjustment.

One improved type of adjustment means is described in Australian Pat. No. 428,763. While this means is most useful and effective, it is somewhat difficult to adjust while the fan is in motion since the adjustment means must be turned against or with the rotation of the turntable.

It is the primary object to provide an adjustment means for a moving head fan, and in particular to provide an adjustment means for a gyratory fan that is operable when the fan is operating.

In its broadest aspect the invention provides a means for adjusting the movement of a moving head fan comprising turntable means adapted to be rotatably driven by the fan motor and having means for holding the pivot member of a moving head mechanism in a plurality of positions including a position in which the member is held coincident with the axis of rotation of the turntable means and at least one other position in which the member is held in a non-coincident position, said turntable including a driven part and an adjusting part which are relatively rotatable with respect to each other to alter the position of said holding means, and means for holding the adjusting part against rotation so that rotation of said driven part causes alteration of the position of said holding means.

In a preferred form involving a gyratory head fan, the driven part supports the holding means which is rotatable about an axis parallel to the axes of rotation. The holding means includes a socket for the ball of the gyratory linkage of the fan head which is arranged so as to be coincident with the axis of rotation in one position of the holding means. The adjusting part preferably has means which are drivingly engaged by the holding means to rotate same when the driven part is rotated relative to the adjusting part. Detent means may be provided to positively locate the holding means in a plurality of positions.

A preferred form of the invention will now be described with reference to the accompanying drawings in which.

While the preferred form is described in relation to a gyratory head fan, the invention is equally applicable to oscillating fans having a turntable incorporating a movable pivot member for adjusting the degree of oscillation of the head.

Figure 2:
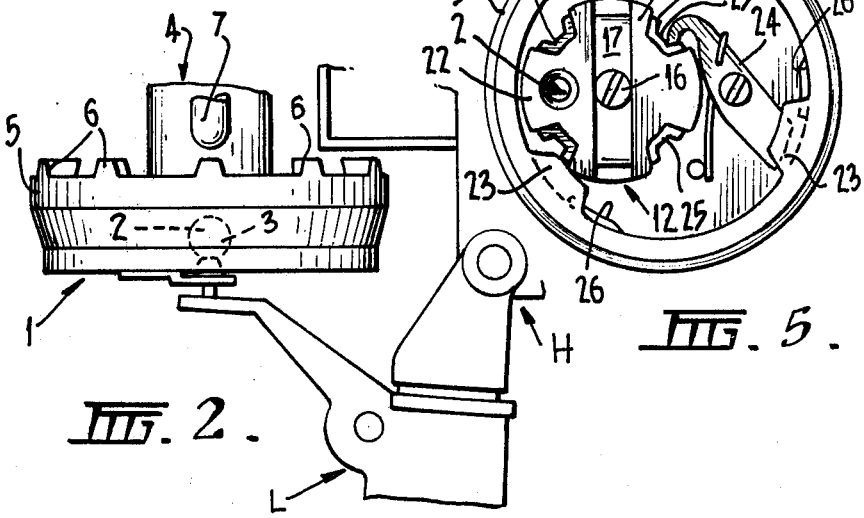
FIG. 2 is a side elevation of the turntable of the adjusting means showing its connection and relationship with the linkage of the gyratory mechanism of the fan.

The improved adjusting means shown in the drawings comprises a turntable 1 mounted on an output shaft (not shown) driven by the fan motor. The turntable 1 includes a socket 2, which is described in further detail below, in which the ball 3 of a standard gyratory fan head linkage L (FIG. 2) is received. Thus as the turntable is rotated the fan head H will gyrate in the usual manner provided the socket 2 is in a off-centre position relative to the axis of rotation of the turntable 1.

Figure 1:
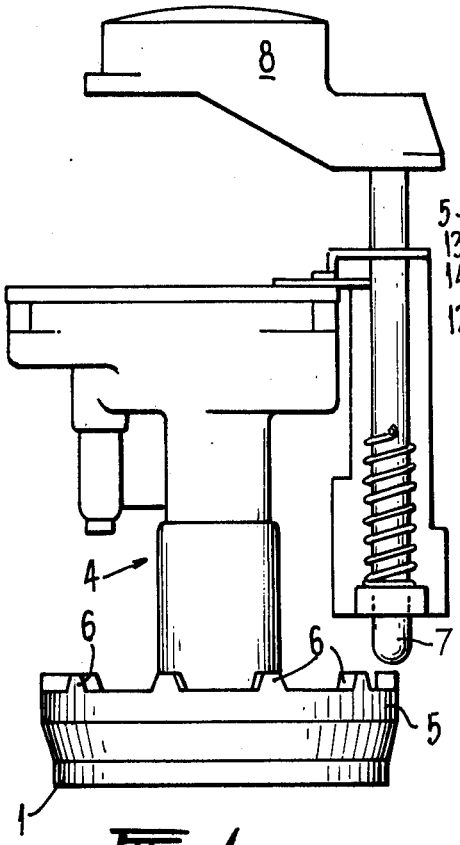
FIG. 1 is a front elevation of the adjusting means mounted on a fan.
Figure 3:
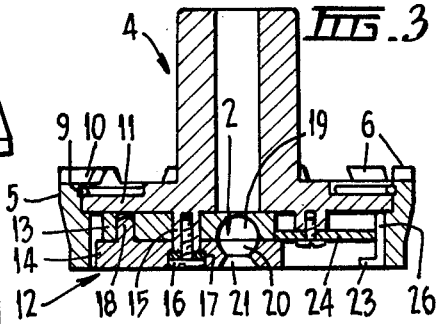
FIG. 3 is a sectional elevation of the turntable.
Figure 4:
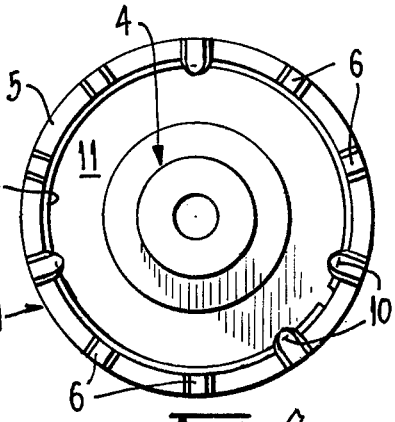
FIG. 4 is a top view of the turntable.
Figure 5:
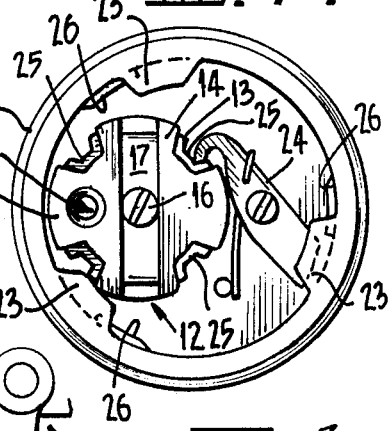
FIG. 5 is an underside view of the turntable.

Referring now to FIGS. 3 to 5, the turntable 1 comprises a driven part 4 and a rim 5 surrounding the driven part 4 such that, when the rim 5 is held against rotation, the driven part 4 may rotate freely with respect thereto. The rim 5 is formed with ten equally spaced abutments 6 on its upper edge adapted to be engaged by a spring loaded plunger 7 (FIG. 1) supported on the fan head H. The plunger 7 has a button 8 whereby it may be manually depressed to engage an abutment 6 to stop rotation of the rim 5. The head of button 8 is adapted to project through an opening in the fan head casing (not shown).

The driven part 4 and rim 5 are held together by means of a circlip 9 which is engaged under lugs 10 projecting over a flange 11 on the driven part 4. The flange 11 is formed with cut out portions (not shown) corresponding to the lugs 10 so that the driven part 4 may be detached from the rim 5.

The driven part 4 supports an adjustment member 12 for rotation about an axis parallel to the axis of rotation of the turntable 1. The adjustment member 12 consists of two plates 13 and 14 mounted on a spindle 15 and held together by a screw 16 engaging a leaf spring 17 interposed between the screw 16 and the plate 14. The plate 14 is formed with a location lug 18 which engages a socket in plate 13 to maintain the plates in a fixed assembly. The plate 13 is formed with an hemispherical depression 19 while the adjacent face of the plate 14 is formed with a partispherical depression 20 which opens into an aperture 21. The two depressions 19 and 20 together define the socket 2 for the ball 3. The plate 14 is captively mounted on the ball 3 prior to its assembly on the linkage L.

The plate 14 is formd with four radial lugs 22 which are adapted to co-operate with three inwardly directed lugs 23 on the rim 5 when the rim 5 is held stationary and the driven part 4 rotated. Thus the position of socket 2 with respect to the axis of rotation of turntable 1 can be altered by holding the rim 5 stationary while the driven part 4 is rotated.

The adjustment member 12 is held in each of its positions by means of a spring loaded pawl 24 engaging notches 25 in the edge of plate 13. The pawl 24 is actuated to release the adjustment member just prior to contact between lugs 22 and 23 by means of cam elements 26 on the rim 5. The pawl is released shortly after the member 12 starts to turn so that it automatically snaps into the next notch 25 when the next position of member 12 is reached.

In the present embodiment, the member 12 can be located in three positions: (1) zero gyration (2) semi gyration and (3) full gyration. However, this may be altered simply by providing more or less notches. By providing a large number of closely spaced notches, virtually infinite variation may be obtained.

In use, the degree of gyration of the fan head H is adjusted by holding the button 8 down until one hears the pawl 24 latch into its next notch. If this adjustment is insufficient the button 8 is simply held down again.

In an alternative form not shown, some form of latching means may be provided for holding the rim 5 as soon as the button 8 is pushed and for releasing the rim as soon as the pawl 24 engages its next notch.

It will be appreciated that the embodiment described may be modified in many ways whilst still remaining within the scope of the invention. For example, the rim 5 and adjustment member 12 may be formed with intermeshing teeth. Similarly, the pawl may be replaced by an inbuilt ratchet device. Furthermore, the plunger arrangement for holding the rim may be replaced by an electrically actuated solenoid which may incorporate control for maintaining the solenoid in an energised state until the next position is reached.

We claim:

1. In a device of the type including a motor driven rotary fan carried by a fan head pivotally disposed for gyrating movement about a first axis, the improvement which comprises a turntable rotatably driven by the fan motor and including a composite assembly rotatable about a second axis, said turntable assembly including a driven part having an adjustment member turnably mounted thereon for movement relative thereto about a third axis, means connecting said adjustment member to said fan head at a location spaced from said third axis, interconnecting means on said turntable assembly normally causing conjoint movement of said adjustment member and said driven part whereby energization of said motor causes said driven part and said adjustment member to normally rotate as a unit about said second axis and said fan head to gyrate through an angle which is a function of the radial distance from said second axis to said fan head connection point, manual means operable during rotation of said driven part to disconnect said interconnecting means causing said adjustment member to turn about said third axis relative to said driven part, whereby to adjust said connection point of said adjustment member and said fan head relative to said second axis and correspondingly the angle of gyration of said fan head.

2. The improvement defined in claim 1 wherein said manual means includes an adjusting part normally rotatable with said driven part and having abuttment means cooperable with abuttment means on said adjustment member when said adjusting part is held against rotation with said driven part.

3. The improvement defined in claim 2 wherein said adjusting part further includes means cooperable with and causing disengagement of said interconnecting means automatically upon holding said adjusting part against rotation with said driven part.

4. The improvement defined in claim 3 wherein said interconnecting means includes a pawl pivoted on said driven part and receivable in notches formed in said adjustment member, said disengagement causing means including cam surfaces formed on said adjusting part.

5. The improvement defined in claim 1 wherein said fan head connection point is adjustable through a plurality of positions, one of said positions being coincident with said first axis wherein said angle of gyration is zero.

6. A means for adjusting the movement of a gyrating head fan comprising a turntable adapted to be rotatably driven by the fan motor, said turntable including a driven part supporting a member for holding the ball of a gyratory linkage for the fan head, said holding member comprising a first plate having a hemispherical depression therein, and a second plate having a partispherical depression opening into an aperture, said plates being held together with said depressions in alignment and facing each other so as to define a socket for said ball, said holding member being rotatable about an axis parallel to the axis of rotation of said turntable, means for maintaining said holding member in a plurality of positions including a position in which said member is held coincident with the axis of rotation of the turntable means and at least one other position in which the member is held in a non-coincident position, said maintaining means including notches in one of said plates and a spring-loaded pawl supported on said driven part and engaging said notches to maintain said holding member in each of its positions, said turntable means further including an adjusting part rotatable relative to said driven part, the other of said plates including lugs formed thereon and engageable with cooperating lugs on said adjusting part on rotation of said driven part relative to said adjusting part, and means for holding said adjusting part against rotation to cause alteration of the position of said holding member when said driven part is rotated, said adjusting part including cam means cooperating with said pawl to disengage it from each notch before said lugs engage each other and to release said pawl for engagement with the next notch before the next position is reached.

* * * * *